US005099170A

United States Patent [19]

Koizumi

[11] Patent Number: 5,099,170

[45] Date of Patent: Mar. 24, 1992

[54] CATHODE SUPPORTING STRUCTURE FOR COLOR CATHODE-RAY TUBE

[75] Inventor: Sachio Koizumi, Mobara, Japan

[73] Assignee: Hitachi, Ltd., Tokyo, Japan

[21] Appl. No.: 578,282

[22] Filed: Sep. 6, 1990

[30] Foreign Application Priority Data

Sep. 13, 1989 [JP] Japan ..... 1-235661

[51] Int. Cl.[5] ..... H01J 29/50

[52] U.S. Cl. ..... 313/417; 313/270; 313/338; 313/414; 313/446

[58] Field of Search ..... 313/417, 446, 270, 338, 313/414

[56] References Cited

U.S. PATENT DOCUMENTS 4,825,122 4/1989 Kakesu et al. ..... 313/417

FOREIGN PATENT DOCUMENTS 57-32532 2/1982 Japan .

57-170434 10/1982 Japan .

58-28155 2/1983 Japan .

59-12546 1/1984 Japan .

*Primary Examiner*—Donald J. Yusko

*Assistant Examiner*—Diab Hamadi

*Attorney, Agent, or Firm*—Antonelli, Terry, Stout & Kraus

[57] ABSTRACT

Three pipes for supporting three cathodes of an electron gun for an in-line type color cathode-ray tube parallel with one another in one and the same plane are arranged in one and the same plane, peripheral portions of the pipes are surrounded by a laterally extending cylindrical outer supporting frame extended in an arranging direction of the pipes through a fixing agent formed of crystallized hard glass powder with low melting point to fix the pipes, and a trapizoidal notch is provided upwardly of a lower side of the cylindrical outer supporting frame and along axes of the pipes to thereby prevent the pipes from being deformed.

14 Claims, 3 Drawing Sheets

CATHODE SUPPORTING STRUCTURE FOR COLOR CATHODE-RAY TUBE

BACKGROUND OF THE INVENTION

The present invention relates to a cathode supporting structure for a color cathode-ray tube in which the arranging directions of three cathodes corresponding to three colors, R, G and B, respectively, of an electron gun of an in-line type color cathode-ray tube are positively held in parallel with one another. The structure is suitable for automatic assembly of the electron gun.

In FIG. 1, reference numeral 1 designates a phase plate; 2 designates a phosphor screen; 4, 5 and 6 designate cathodes comprising an electron gun for emitting three colors, R, G and B, respectively; and 3 designates a supporting structure for said cathodes. Reference characters $G_1$, $G_2$, $G_3$ and $G_4$ designate a first, a second, a third and a fourth grid, respectively.

In the in-line type color cathode-ray tube (shown in FIG. 1), three electron beams of an electron gun held in parallel with one another within the tube have to be present within one and the same plane. In this case, the electron emitting directions from the cathodes are required to be parallel with one another at least in a section from the cathode to the first grid electrode, to which the end the cathodes have to be supported in the direction parallel with one another within one and the same plane.

The color cathode-ray tubes are produced on a large scale. Therefore, the work can be accomplished so that the electron gun may be assembled simply and easily and the members may be accurately held at a predetermined relative position.

Normally, three cathodes are supported in a direction parallel with one another within one plane. In accordance with the aforementioned conditions, for example, Japanese Patent Application Laid-Open No. 57(1982)-170434 discloses a cathode supporting structure for a color cathode-ray tube having a construction in which as shown in FIGS. 2*a* and 2*b*, outer peripheral portions of three metal pipes for inserting a cathode 23*a*, 23*b* and 23*c* disposed in parallel with one another within one plane are surrounded by a single metallic elliptic outer supporting frame 22. Powdery glass 24 is filled between said outer supporting frame 22 and the three metal pipes 23*a*, 23*b* and 23*c* for inserting a cathode, and the powdery glass 24 is subjected to fixing by hot melting while accurately holding the relative position of the aforementioned members. Automation of the assembling steps is relatively easy.

In the above-described prior art, and in consideration of reliability with respect to fixing between the metal members and glass after assembled, the coefficient of thermal expansion is set in the relationship of the outer supporting frame > crystallized glass > metal pipe. More specifically, nickel-iron alloy for hermetic sealing soft glass, crystallized hard glass powder with low melting point are subject to fixing by hot melting, and iron-nickel cobalt for hermetic sealing hard glass are selected for the outer supporting frame 22, the glass powder 24 and the metal pipes 23*a*, 23*b* and 23*c*, respectively, whereby the effect of a shrinkage fit is obtained between the respective members after the step of fixing by hot melting of the crystallized hard glass powder with a low melting point.

In the past, an axial length $L_3$ of the metal pipes 23*a* to 23*c* of the outer supporting frame 22 is more than twice of an axial length $L_2$ of the metal pipe in the crystallized glass portion fixed by hot melting, and the object for firmly fixing the members from each other has been fully achieved by the aforesaid section of materials. However, after the cathode supporting structure is completed, one lengthwise end of the outer supporting frame 22 (corresponding to the upper end in FIG. 2*b*) registers with one end of the crystallized glass portion 24 (corresponding to the upper end shown). However, the length $L_3$ of the outer supporting frame 22 is twice of the length $L_2$ of the glass portion and the other end of the outer supporting frame 22 extends beyond the other end of the crystallized glass portion and at a position extending in excess of the height of the glass portion. Therefore, the local shrink-force of a part of non-sealing in metallic outer supporting frame of the metal outer supporting frame 22 (in which crystallized glass portion is not present) intensively acts so that ends 23*a*' and 23*c*' of two outer pipes 23*a* and 23*c* among three metal pipes 23*a* to 23*c*, said ends 23*a*' and 23*c*' being located on the side wherein the outer supporting frame 22 extends downwardly of the end of the glass portion, are moved toward the center pipe 23*b*, and as a result, the arranging directions of three metal pipes 23*a* to 23*c* became not parallel with one another as shown in FIG. 2*c* ($P_1' < P_1$, and $P_2' < P_2$).

The pitch between the three metal pipes corresponds to pitches $P_1$ and $P_2$ between three electron beams of the in-line type color cathode-ray tube, and an error of $\pm$ 0.05 mm or more is not allowed. On the other hand, the prior art has a problem in that only the stress deformation caused by a difference in the aforementioned coefficient of thermal expansion (as shown at $P_1'$ and $P_2'$ in FIG. 2*c*) results in an error in excess of the aforesaid allowable error.

SUMMARY OF THE INVENTION

In order to support three cathodes of an electron gun of an in-line type color cathode-ray tube in parallel with one another in one and the same plane, the present invention provides an arrangement comprising three pipes for inserting a cathode made of alloy for hermetic sealing hard glass arranged in correspondence to positions of said cathodes, respectively, a laterally extending cylindrical outer supporting frame surrounding in common the peripheries of said pipes, and a portion filled with harden glass with low melting point between said pipes and said cylindrical outer supporting frame, wherein both sides in a longitudinal direction of said cylindrical outer supporting frame are provided with trapezoidal notches upwardly of the low side of said cylindrical outer supporting frame (or "outer frame" in short) and in an axial direction of the upper pipe.

DESCRIPTION OF THE PREFERRED EMBODIMENT

Figure 1:
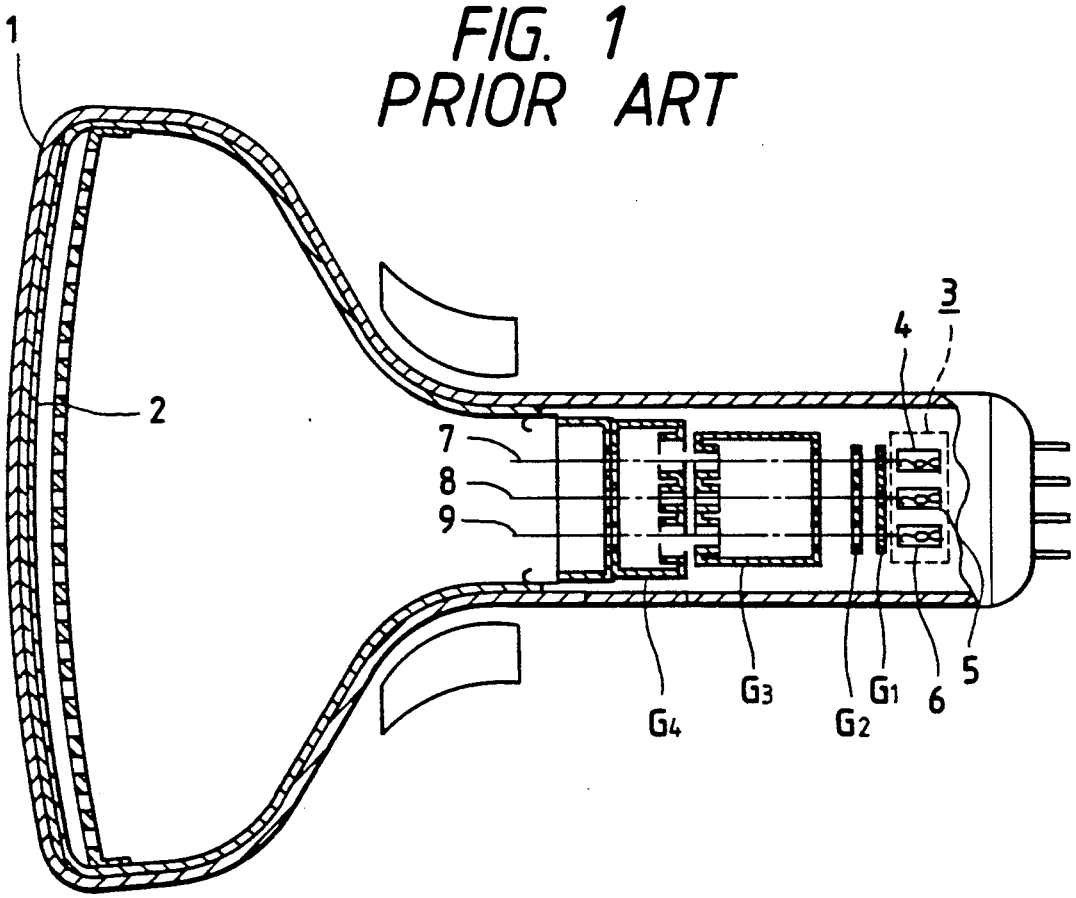
FIG. 1 PRIOR ART
FIG. 1 is a view showing schematic structure of a well known in-line type color cathode-ray tube.
Figure 2A:
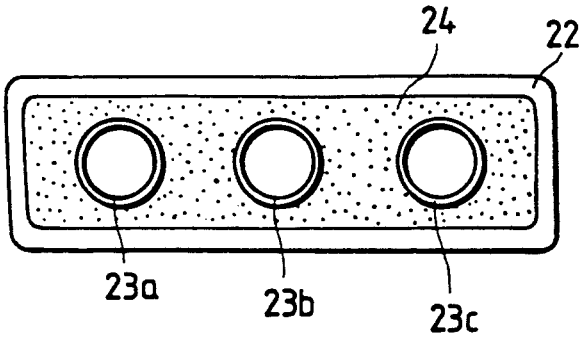
FIG. 2a PRIOR ART
FIGS. 2*a*, 2*b* and 2*c* are a top view and cross-sectional views, respectively, of essential parts of a cathode supporting structure of the well known in-line type color cathode-ray tube.
Figure 2B:
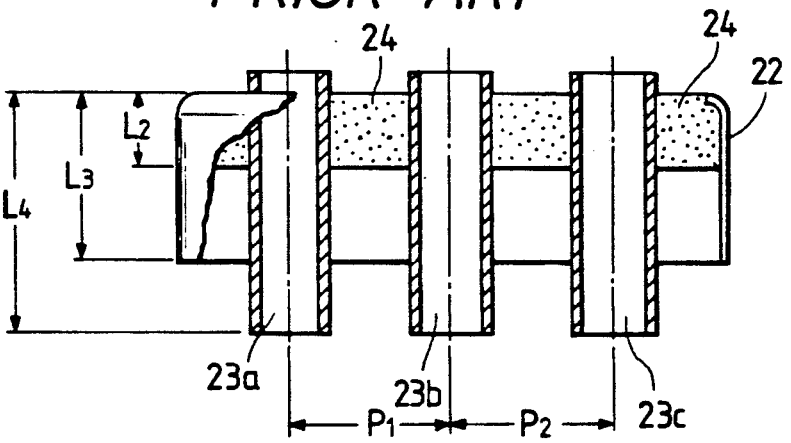
FIG. 2b PRIOR ART
Figure 2C:
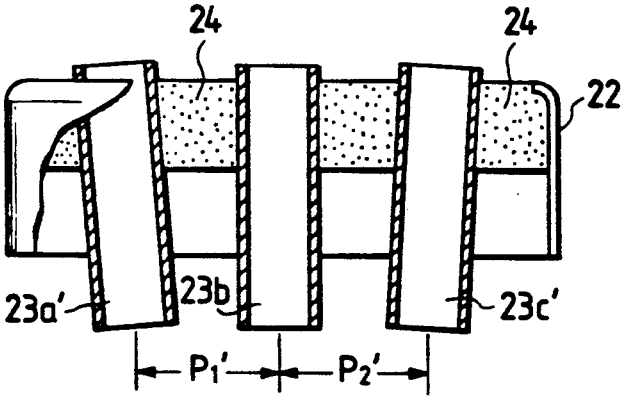
FIG. 2c PRIOR ART

For achieving the aforesaid object, the present invention provides an arrangement wherein in order to support three cathodes of an electron gun of an in-line type color cathode-ray tube in parallel with one another within one and the same plane, peripheral portions of three pipes for inserting a cathode 31*a*, 31*b* and 31*c* made, for example, of alloy for hermetic sealing hard glass, arranged at a predetermined relative position are surrounded in common, a cylindrical outer supporting frame 32 made of alloy for hermetic sealing soft glass and outer periphery of which has a laterally extending shape such as an ellipse is arranged at a predetermined relative position, and crystallized hard glass powder with low melting point 33 is filled between these metal members, that is, between the pipes for inserting a cathode indicated at 31*a* to 31*c* and said cylindrical outer supporting frame 32. In a cathode structure of a color cathode-ray tube in which the glass powder 33 is subjected to fixing by hot melting while accurately holding the relative position between said members, a value of an axial length $l_3$ of said pipe of the cylindrical outer supporting frame 32 is made 1.1 to 1.6 times of an axial length $l_2$ of the pipe of the melted glass portion over an area 20% or more of a length $W_1$ of a long side of the outer peripheral portion of the outer supporting frame having a laterally extending trapezoidal shape such as an ellipse. That is, this will be the value of $l_3$ as indicated by $l_3=(1.1-1.6)l_2'$.

In portions other than the axial length of the pipe having the aforesaid magnification (for example, in the vicinity of both ends in a longitudinal direction of an elliptical outer supporting frame), it is necessary to fix to the part of non-sealing corresponding to axial length $l_{2'}$ of outer supporting frame 32 a metallic intermediary member for mounting the cathode supporting structure together with electrodes on insulating supporting rods (glass powder molded products normally called multiform glass) which support electrodes of the electron gun while insulating them from each other by welding or the like, and the height of the part of non-sealing corresponding to axial length $l_{2'}$ of outer supporting frame 32 should be present to a degree that an electrode of a welder can enter (accordingly, above the aforesaid magnification).

When the lower limit value of the magnification lowers to a value less than 1.1, overflow of glass occurs, and glass adheres to the edge of the outer supporting frame 32, possibly resulting in cracks. Conversely, if the upper limit value, 1.6 is exceeded, the force of the part of non-sealing corresponding to the axial length $l_{2'}$ of outer supporting frame 32 increases, resulting in a possible occurrence that the arrangement of the three metal pipes are not parallel with one another. Also in the case where the portion having the aforesaid magnification is less than 20% of the longitudinal length of the outer supporting frame, the parallelism of arrangement of the metal pipes cannot likewise possibly be maintained.

By using the outer supporting frame 32 under the conditions as noted above, stress acting on the neighborhood of both (upper and lower) surfaces in an axial direction of the metal pipe of the crystallized glass fixed by hot melting forms into a compressive stress having approximately the same degree as the former, as a consequence of which after the crystallized glass powder with low melting point 33 has been fixed by hot melting, three metal pipes are maintained parallel with one another with sufficient accuracy and a deviation of pitch between axes of the pipes is within an allowable tolerance.

Figure 3:
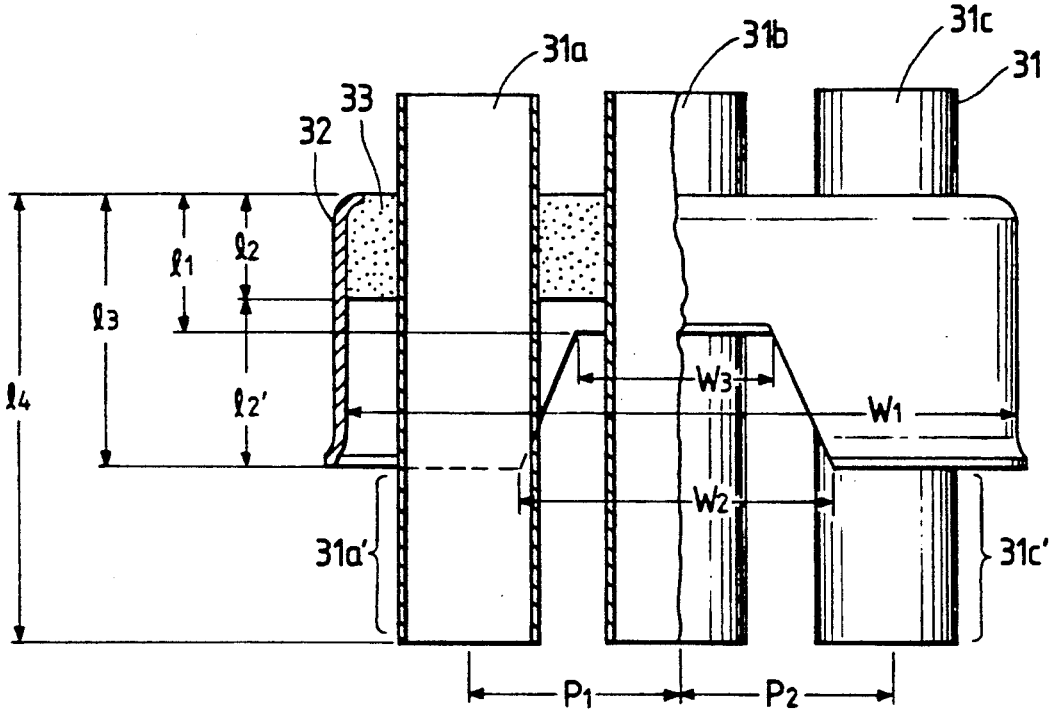
FIG. 3 view showing a cathode supporting structure of the present invention partly in section.

FIG. 3 is a sectional view showing essential parts of one embodiment according to the present invention. In FIG. 3, reference numerals 31*a* to 31*c* designate pipes for inserting a cathode made of iron-nickel-cobalt alloy for hermetic sealing hard glass (cobalt A); 32 designates an outer supporting frame made of 42% nickel-iron alloy for hermetic sealing soft glass (material for a core of a wire for introducing an incandescent sealing portion); and 33 designates a crystallized glass obtained by fixing by hot melting crystallized harden glass powder with low melting point. The height $l_1$ in an axial direction of pipe of the outer supporting frame 32 is 1.8 mm, and the height $l_2$ in an axial direction of pipe of the crystallized glass 33 is 1.5 mm, the relation therebetween being $l_1/l_2=1.2$.

Figure 4:
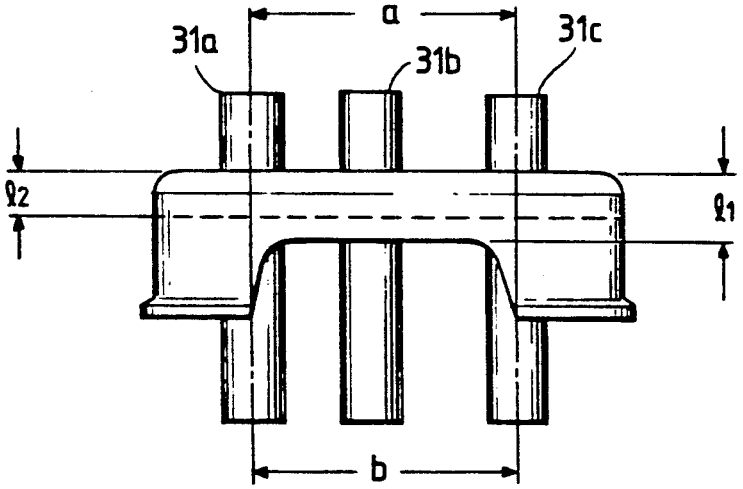
FIG. 4 is a view for showing the schematic structure and explaining the characteristics of the cathode supporting structure according to the present invention.

In the present embodiment, an inclination between the pipes 31*a* to 31*c* can be hardly seen, and a pitch error between the pipes (which is a pitch difference between the upper side and the lower side of the crystallized glass and is also called an eyelet pitch error, indicated by a difference between a and b (a−b) in FIG. 4) can be made to 5 mm.

As described above, according to the present invention, a cathode-ray supporting structure of an in-line type color cathode-ray tube can be formed simply and with high accuracy so that neither pitch error nor inclination between the three pipes for inserting a cathode occurs. Therefore, workability of assembling electrodes of an electron gun is improved to render automation and labor-saving easy.

What is claimed is:

1. A cathode supporting structure for an in-line type color cathode-ray tube, said cathode supporting structure comprising:

a plurality of pipes for receiving a plurality of cathodes corresponding to said in-line type color cathode-ray tube;

a cylindrical outer frame for supporting said plurality of pipes, a periphery of said cylindrical outer frame surrounding said plurality of pipes, said plurality of pipes being generally aligned in a longitudinal direction of said cylindrical outer frame, said cylindrical outer frame comprising a first portion for fixing said plurality of pipes in said cylindrical outer frame by a fixing agent; and said cylindrical outer frame further comprising notches in two surfaces in the longitudinal direction of said cylindrical outer frame, said notches extending in an axial direction of said plurality of pipes.

2. The cathode supporting structure according to claim 1, wherein said plurality of pipes are located substantially in the center of the cylindrical outer frame.

3. The cathode supporting structure according to claim 1, wherein a cross-section of said cylindrical outer frame is substantially elliptical.

4. The cathode supporting structure according to claim 1, wherein said cylindrical outer frame further comprises a second portion, and each of said plurality of pipes comprises a first length and a second length, said plurality of pipes not being fixed to the cylindrical outer frame in said second portion, said first length corresponding to the length in the axial direction of the first portion and the length of the second portion, said second length corresponding to the length in the axial direction of the first portion, said first length being from 1.1 to 1.6 times the second length.

5. The cathode supporting structure according to claim 1, wherein said fixed portion is filled with a crystallized hard glass powder having a low melting point, said crystallized hard glass powder fixing said plurality of pipes after the hard glass powder is melted.

6. The cathode supporting structure according to claim 1, wherein said cylindrical outer frame further comprises an outer peripheral portion for hermetically sealing said fixed portion, said outer peripheral portion comprising an alloy.

7. The cathode supporting structure according to claim 6, wherein the alloy is nickel-cobalt.

8. The cathode supporting structure according to claim 1, wherein a cross-section of each of the notches is substantially trapezoidal shaped, said each of said notches comprising a lower notch surface and an upper notch surface, a direction of the lower and upper notch surfaces being in said axial direction of the plurality of pipes.

9. The cathode supporting structure according to claim 8, wherein the lower notch surface is adjacent to a lower surface of the cylindrical outer frame, the area of the lower notch surface being greater than the area of the upper notch surface.

10. The cathode supporting structure according to claim 8, wherein said each of said notches comprises a third length measured in the longitudinal direction and corresponding to the length of a surface of said notch, the direction of the surface being in the axial direction, said cylindrical outer frame further comprising a fourth length, said fourth length corresponding to the length of the cylindrical outer frame in the longitudinal direction, the third length being more than 20% of the fourth length.

11. A cathode supporting structure for an in-line type color cathode-ray tube, said cathode supporting structure comprising:

three pipes for receiving three cathodes corresponding to said in-line type color cathode-ray tube;

a cylindrical outer frame for supporting said three pipes, a periphery of said cylindrical outer frame surrounding said three pipes, said three pipes being generally aligned in the longitudinal direction of said cylindrical outer frame, said cylindrical outer frame comprising a first portion for fixing said plurality of pipes in said cylindrical outer frame, said fixed portion being filled with a crystallized hard glass powder having a low melting point, said crystallized hard glass powder fixing said three pipes after the glass powder is melted; and said cylindrical outer frame further comprising notches in two surfaces in the longitudinal direction of said cylindrical outer frame, said notches extending in an axial direction of said three pipes.

12. The cathode supporting structure according to claim 11, wherein a cross-section of each of the notches is substantially trapezoidal shaped, each of said notches comprising a lower notch surface and an upper notch surface, a direction of the lower and upper notch surfaces being in said axial direction of the three pipes.

13. The cathode supporting structure according to claim 11, wherein said cylindrical outer frame further comprises a second portion, and each of the three pipes comprises a first length and a second length, said three pipes not being fixed to the cylindrical outer frame in said second portion, said first length corresponding to the length in the axial direction of the first portion and the length of the second portion, said second length corresponding to the length in the axial direction of the first portion, said first length being from 1.1 to 1.6 times the second length.

14. The cathode supporting structure according to claim 12, wherein said each of said notches comprises a third length in the longitudinal direction corresponding to the length of a surface of said notch, the direction of the surface being in the axial direction, said cylindrical outer frame comprising a fourth length, said fourth length corresponding to the length of the cylindrical outer frame in the longitudinal direction, the third length being more than 20% of the fourth length.

* * * * *

UNITED STATES PATENT AND TRADEMARK OFFICE

CERTIFICATE OF CORRECTION

PATENT NO. : 5,099,170

DATED : March 24, 1992

INVENTOR(S) : S. KOIZUMI

It is certified that error appears in the above-indentified patent and that said Letters Patent is hereby corrected as shown below:

Column 2, lines 1 and 2, delete "of the metal pipes 23a to 23c".

Column 3, line 24, change "$l_3$" to -- $l_1$ --;

line 30, change "$l_3$" to -- $l_1$ --;

line 31, change "$l_3 = (1.1 - 1.6)\ l_2'$ " to -- $l_1 = (1.1 - 1.6)\ l_2$ --.

Column 4, line 26, change "5 mm" to -- 5 μm --.

Signed and Sealed this

Twentieth Day of April, 1999

*Attest:*

Q. TODD DICKINSON

*Attesting Officer*

*Acting Commissioner of Patents and Trademarks*